US009475111B2

(12) United States Patent
Tsuchiya et al.

(10) Patent No.: US 9,475,111 B2
(45) Date of Patent: Oct. 25, 2016

(54) MANUFACTURING METHOD OF PRESS PRODUCT AND PRESS FORMING APPARATUS

(75) Inventors: Takashi Tsuchiya, Tochigi (JP); Teruo Kamada, Tochigi (JP); Daisuke Yamamoto, Tochigi (JP); Kaoru Hirotani, Tochigi (JP); Kenji Matsutani, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 208 days.

(21) Appl. No.: 13/456,740

(22) Filed: Apr. 26, 2012

(65) Prior Publication Data

US 2012/0279273 A1 Nov. 8, 2012

(30) Foreign Application Priority Data

May 2, 2011 (JP) ..... 2011-102850

(51) Int. Cl.
*B21D 22/22* (2006.01)
*B21D 22/02* (2006.01)

(52) U.S. Cl.
CPC ..... *B21D 22/02* (2013.01); *B21D 22/22* (2013.01)

(58) Field of Classification Search
CPC ..... B21D 22/30; B21D 22/28; B21D 51/26; B21D 22/26; B21D 51/38; B21D 22/22; B21D 24/04; B21D 5/02; B21D 19/08; B21D 22/02
USPC ..... 72/347, 348, 350, 379.2, 462, 470, 474, 72/475
See application file for complete search history.

(56) References Cited

U.S. PATENT DOCUMENTS

| | | | | |
|---|---|---|---|---|
| 4,373,371 | A * | 2/1983 | Liu | 72/374 |
| 7,117,708 | B2 * | 10/2006 | Yamano et al. | 72/350 |
| 8,522,593 | B2 * | 9/2013 | Flehmig et al. | 72/348 |
| 2001/0013242 | A1 * | 8/2001 | Kondou et al. | 72/379.2 |
| 2004/0244458 | A1 * | 12/2004 | Yamano et al. | 72/350 |
| 2008/0299352 | A1 * | 12/2008 | Matsuda et al. | 428/174 |
| 2009/0205394 | A1 * | 8/2009 | Luckey et al. | 72/379.2 |
| 2010/0133724 | A1 * | 6/2010 | Flehmig et al. | 264/294 |
| 2012/0180542 | A1 * | 7/2012 | Golovashchenko | 72/57 |

FOREIGN PATENT DOCUMENTS

| | | |
|---|---|---|
| CN | 1806957 | 7/2006 |
| JP | S47-25266 | 7/1972 |
| JP | S60-9521 | 1/1985 |
| JP | S62-64423 | 3/1987 |
| JP | H02-207923 | 8/1990 |
| JP | 07-080550 | 3/1995 |
| JP | H08-187513 | 7/1996 |
| JP | 8-215759 | 8/1996 |
| JP | 2004-154839 | 6/2004 |
| JP | 2004-181502 | 7/2004 |
| JP | 2008-307557 | 12/2008 |
| JP | 2009-262168 | 11/2009 |

* cited by examiner

*Primary Examiner* — David Bryant
*Assistant Examiner* — Lawrence Averick
(74) *Attorney, Agent, or Firm* — Rankin, Hill & Clark LLP

(57) ABSTRACT

A product including a top surface part, a vertical wall part connected to an end of the top surface part and a corner part interposed between the top surface part and the vertical wall part is manufactured by flowing a material of the corner part toward the top surface part while applying a pressing force on a workpiece.

2 Claims, 12 Drawing Sheets

MANUFACTURING METHOD OF PRESS PRODUCT AND PRESS FORMING APPARATUS

BACKGROUND OF THE INVENTION

1. Field of the Invention

The present invention relates to a manufacturing method of a press product and a press forming apparatus capable of obtaining a product by bending a workpiece.

2. Related Art

For example, when a corner part is formed on a metal plate by a drawing process or a bending process, a press forming of the metal plate is performed by applying a predetermined pressing force on the metal plate to bend the metal plate by a predetermined angle. As a result, a product having the corner part and its surrounding parts is obtained. However, if the product is released from the pressing force, the corner part and its surrounding parts bounce in a direction opposite to an applying direction of the pressing force. That is, so-called spring-back is occurred. Especially, the spring-back is remarkable in a high tensile strength material such as a high tensile steel plate.

Of course, the forming die for performing the press forming process is set so that an angle of the corner part of the metal plate after the spring-back occurs corresponds to a predetermined angle. That is, the forming die is designed in consideration of the spring-back so that a product having a desired shape is obtained.

However, even if the forming die thus designed is used to perform the press forming process, there is often the case that a real quantity of the spring-back is different from an estimated quantity of the spring-back. In this case, it is necessary to amend the forming die.

As such, dimensions or the pressing force of the forming die for the press forming process leads to a final setting by repeating a test of the press forming, a correction of the forming die based on the real quantity of the spring-back and retest of the press forming. On this account, the number of the process leading up to the final setting is increased and a long manufacturing time is required.

Accordingly, it is required to reduce the spring-back as far as possible. In this case, since the non-uniformity in the amount of the spring-back is also decreased, it is easy to estimate the amount of the spring-back. As a result, it is expected that the number of the process leading up to the final setting of the forming die is reduced and the manufacturing time is short.

JP-A-08-215759 discloses a technique for locally upsetting the workpiece in order to reduce the spring-back. Specifically, a forming die having a protrusion presses a corner part of the workpiece and thus the corner part is plastically deformed. As a result, a golf club head of which thickness is locally thin is obtained.

In the technique disclosed in JP-A-08-215759, the corner part of the workpiece is locally pressed by the protrusion while the workpiece is constrained in the forming die. Therefore, the workpiece is clinched by the protrusion and thus the material is difficult to flow during the press forming process. For this reason, there is a risk that the workpiece is broken. Further, since the thickness of the corner part is locally thin, the strength of the corner part is degraded. Consequently, it is difficult to adopt such a press-product as a high strength structural material such as a vehicle panel, for example.

SUMMARY OF THE INVENTION

One or more embodiments of the invention relate to a manufacturing method of a press product and a press forming apparatus capable of preventing a spring-back from occurring in the press-product which is subjected to a bending process.

DETAILED DESCRIPTION OF THE EMBODIMENTS

Figure 1:
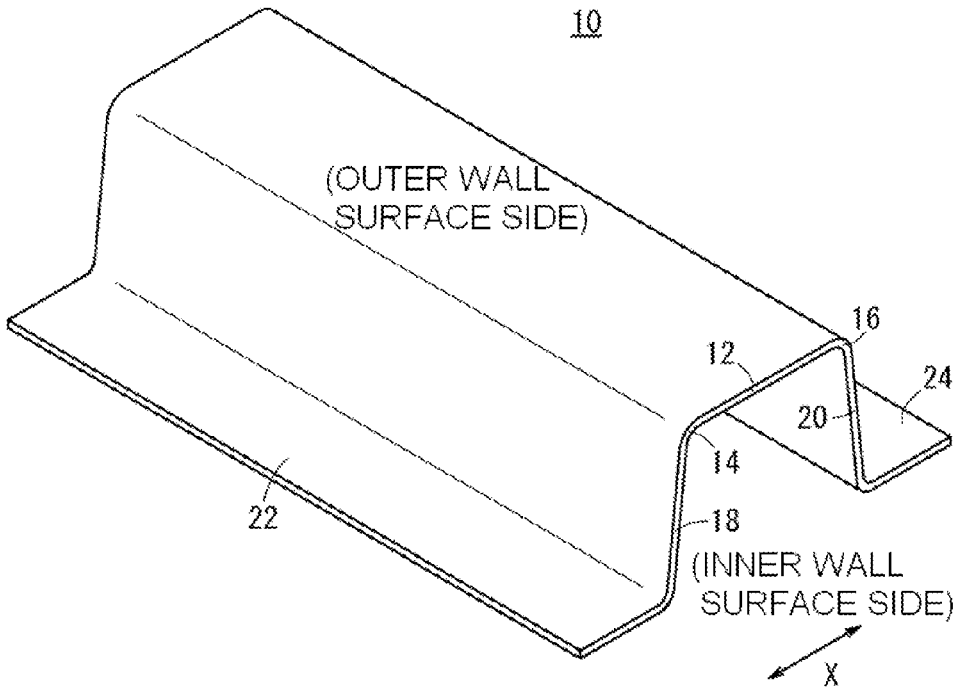
FIG. 1 is an overall perspective view schematically illustrating a press-product.

Hereinafter, embodiments of a manufacturing method of a press product and a press forming apparatus will be described in detail by the referring to accompanying drawings. The embodiments and their modifications described herein are not intended to limit the invention but only to exemplify the invention, and all features or combinations of the features of the embodiments and the modifications are not always essential to the invention. In a first embodiment, a case of obtaining a press-product 10 illustrated in FIG. 1 from a plate-shaped workpiece will be described as an example.

The press-product 10 will be described. The press-product 10 is obtained from a workpiece W1 (see, FIG. 2) which is made of high tensile steel and has an initial thickness t, for example. The press-product 10 includes a ceiling wall 12 as a top surface part, a first corner part 14 and a second corner part 16 as corner parts, a first slant wall 18 and a second slant wall 20 as vertical wall parts. The ceiling wall 12 extends in a horizontal direction (arrow X direction in FIG. 1). The first slant wall 18 is continued to the ceiling wall 12 via the first corner part 14 and the second slant wall 20 is continued to the ceiling wall 12 via the second corner part 16. Further, a first flange 22 and a second flange 24 are respectively continued to the first slant wall 18 and the second slant wall 20. The first flange 22 and the second flange 24 extend parallel to the extending direction of the ceiling wall 12.

The first slant wall 18 and the second slant wall 20 are joined to the ceiling wall 12 in an approximately 90 degree. The first slant wall 18 and the second slant wall 20 may be slightly inclined to the vertical direction. In this case, the ceiling wall 12 forms a slightly open U shape together with the first slant wall 18 and the second slant wall 20. Further, each of an angle between the first slant wall 18 and the ceiling wall 12 and an angle between the ceiling wall 12 and the second slant wall 20 is approximately 90 degree in the inner wall side of the first corner part 14 and the second corner part 16 and is approximately 270 degree in the outer wall side thereof.

As discussed below, the first corner part 14, the second corner part 16, the first slant wall 18, the second slant wall 20, the first flange 22 and the second flange 24 are formed by performing a bending process (press forming process) for the workpiece W1 having the initial thickness t.

Figure 2:
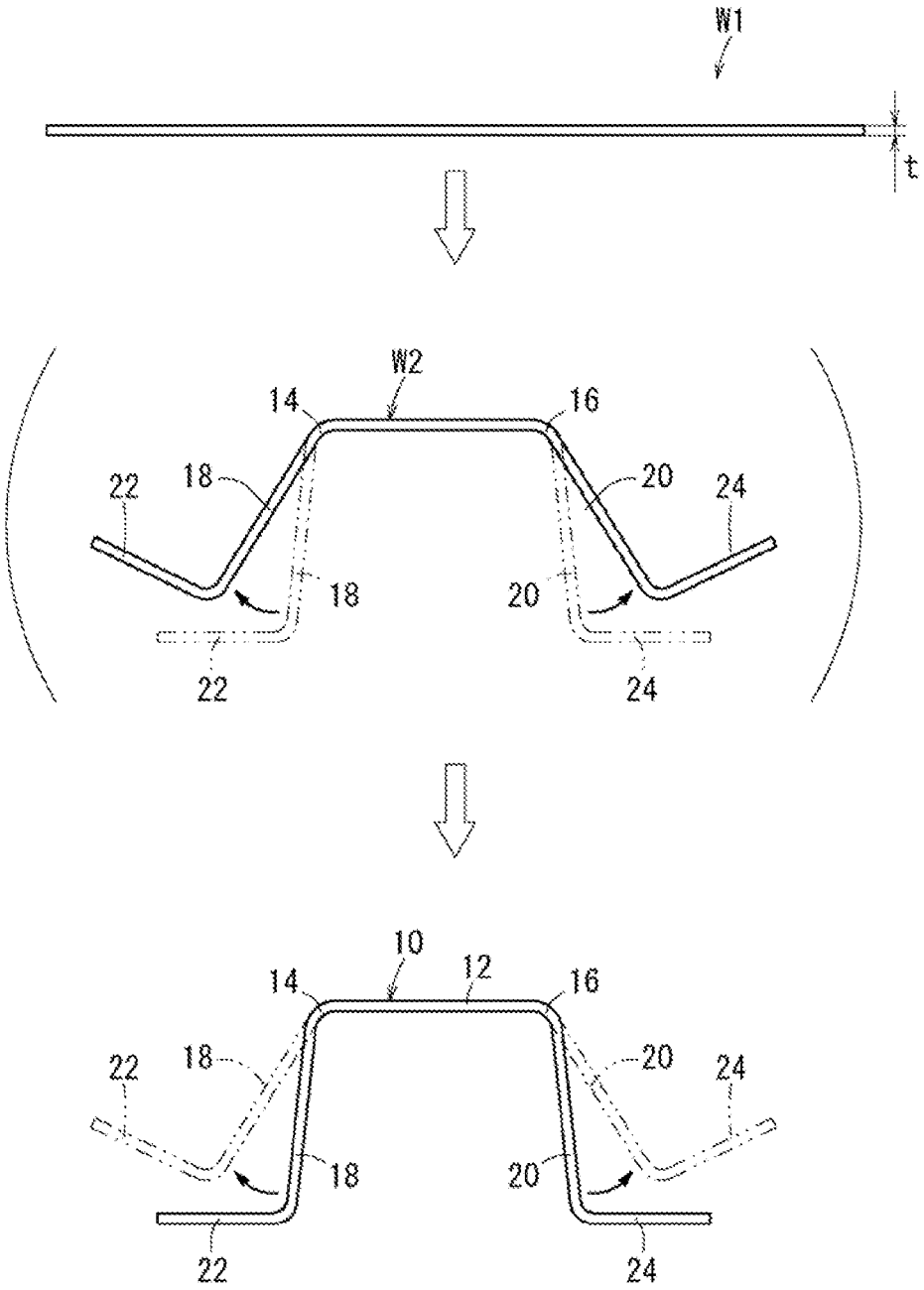
FIG. 2 is a schematic side view illustrating a workpiece machining process according to a first embodiment.

As illustrated in FIG. 2, the press-product 10 thus shaped can be manufactured through a first press forming process in which a preform W2 is obtained from the workpiece W1 and a second press forming process in which the press-product 10 is obtained from the preform W2. Hereinafter, this case will be described as a first embodiment.

Herein, a first press forming apparatus 26 for performing the first press forming process will be described by referring to FIGS. 3 and 4. The first press forming apparatus 26 performs so-called drawing process. The first press forming apparatus 26 includes a first lower die 28, a first upper die 30 and a plurality of blank holders 32. The first lower die 28 is a forming die for bending the workpiece W1. The first upper die 30 is approaching or retreating from the first lower die 28 under the action of a lifting mechanism (not illustrated). The blank holders is configured to retain the workpiece W1. Herein, two of the pluralities of blank holder 32 are illustrated in FIG. 2.

That is, in this case, the first lower die 28 is a fixed die which is fixedly positioned and the first upper die 30 is a movable die which can be displaced. The first lower die 28 includes a first convex portion 36 and therefore has a convex shape toward the first upper die 30. Meanwhile, the first upper die 30 is provided with a first concave portion 40 into which the first convex portion 36 of the first lower die 28 moves and therefore has a concave shape due to the first concave portion 40.

The pluralities of blank holder 32 are provided to surround the first lower die 28 and respectively supported on cushion pins 42 which extend from a biasing means (not illustrated). The blank holders 32 can be displaced in accordance with an advancing (lifting) or retreating (lowering) action of the cushion pin 42 in a vertical direction in FIG. 3.

Figure 4:
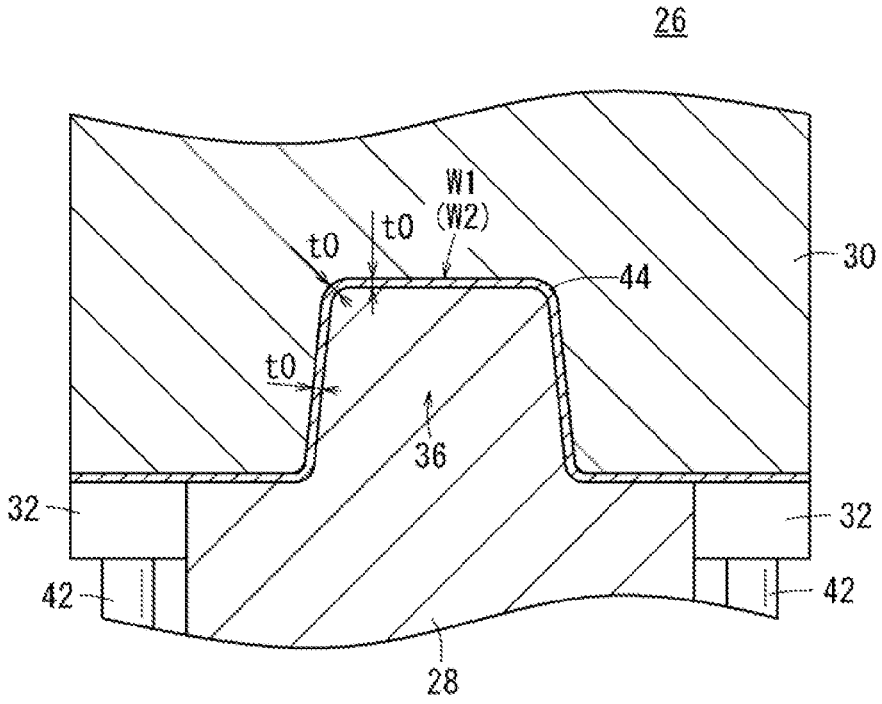
FIG. 4 is a longitudinal sectional view schematically illustrating a main part of the first press forming apparatus in a state where the upper die constituting the first press forming apparatus is maximally lowered.

As illustrated in FIG. 4, when the first lower die and the first upper die are closed, the first convex portion 36 moves into the first concave portion 40 and thus a first cavity 44 is formed.

A clearance between the first lower die 28 and the first upper die 30 corresponds to the initial thickness t of the workpiece W1.

Figure 5:
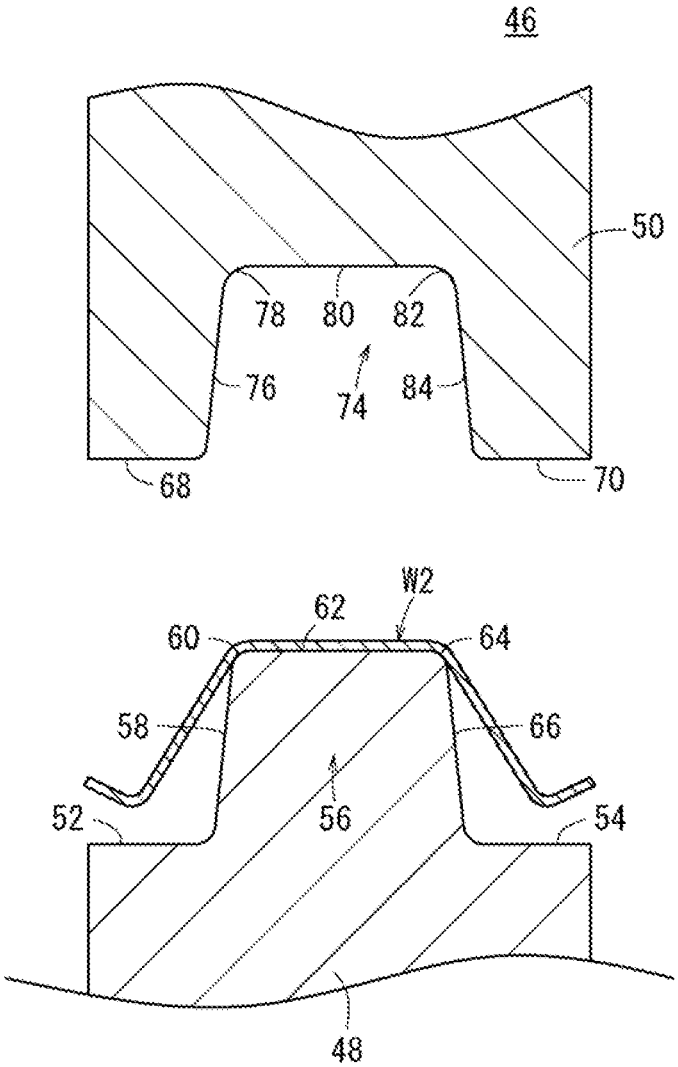
FIG. 5 is a longitudinal sectional view schematically illustrating a main part of a second press forming apparatus according to the first embodiment.

Next, a second press forming apparatus 46 as a press forming apparatus according to the first embodiment will be described by referring to FIGS. 5 and 6. Naturally, the second press forming apparatus 46 is configured to perform the second press forming process.

The second press forming apparatus 46 includes a second lower die 48 on which the preform W2 is placed and a second upper die 50 which is approaching or retreating from the second lower die 48 under the action of a lifting mechanism (not illustrated). Also, in this case, the second lower die 48 is a fixed die which is fixedly positioned and the second upper die 50 is a movable die which can be displaced.

The second lower die 48 includes a first flange forming surface 52 for forming the first flange 22, a second flange forming surface 54 for forming the second flange 24 and a second convex portion 56 interposed between the first flange forming surface 52 and the second flange forming surface 54. The second lower die 48 has a convex shape toward the second upper die 50 due to the second convex portion 56.

The second convex portion 56 includes a first slant forming surface 58, a first corner forming surface 60, a first top forming surface 62, a second corner forming surface 64 and a second slant forming surface 66 which are provided in this order from the first flange forming surface 52 toward the second flange forming surface 54. Naturally, the first slant forming surface 58 and the second slant forming surface 66 are configured to form the first slant wall 18 and the second slant wall 20. The first corner forming surface 60 and the second corner forming surface 64 are configured to form the first corner part 14 and the second corner part 16. Further, the first top forming surface 62 retains the portion of the preform W2 corresponding to the ceiling wall 12 of the press-product 10 in collaboration with the second upper die 50.

The second upper die 50 includes a third flange forming surface 68, a fourth flange forming surface 70 and a second concave portion 74 interposed between the third flange forming surface 68 and the fourth flange forming surface 70. As the second convex portion 56 moves into the second concave portion 74, a second cavity 72 (see, FIG. 6) is formed between the second convex portion 56 and the second concave portion 74. The second upper die 50 has a concave shape due to the second concave portion 74.

The second concave portion 74 includes a third slant forming surface 76, a third corner forming surface 78, a second top forming surface 80, a fourth corner forming surface 82 and a fourth slant forming surface 84 which are provided in this order from the third flange forming surface 68 toward the fourth flange forming surface 70. Herein, the third slant forming surface 76 and the fourth slant forming surface 84 are respectively opposed to the first slant forming surface 58 and the second slant forming surface 66. The third corner forming surface 78 and the fourth corner forming surface 82 are respectively opposed to the first corner forming surface 60 and the second corner forming surface 64. Further, the second top forming surface 80 retains the portion of the preform W2 corresponding to the ceiling wall 12 of the press-product 10 in collaboration with the first top forming surface 62 of the second lower die 48.

Figure 6:
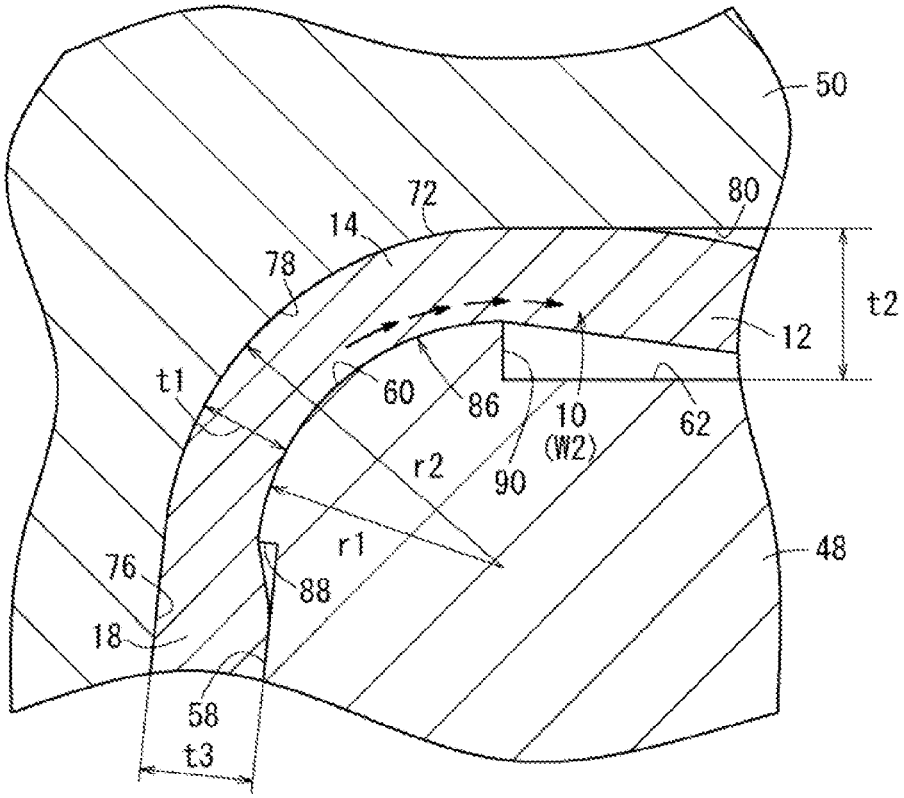
FIG. 6 is a longitudinal sectional view schematically illustrating a main part of an area for forming a corner part in the second press forming apparatus.

Herein, FIG. 6 is an enlarged view illustrating the vicinity of the first corner forming surface 60 in a state where the second lower die and the second upper die are closed. As is apparent from FIG. 6, the first corner forming surface 60 is provided with an arc-shaped protruding portion 86 protruding therefrom. That is, a step 88 is formed between the arc-shaped protruding portion 86 and the first slant forming surface 58 and a step 90 is formed between the arc-shaped protruding portion 86 and the first top forming surface 62.

In the first embodiment, in the second cavity 72, the following equation (1) is established.

$$t1<t<t2 \quad (1)$$

where t1 is a clearance between the arc-shaped protruding portion 86 and the third corner forming surface 78, t2 is a clearance between the first top forming surface 62 and the second top forming surface 80 and t is the initial thickness of the workpiece W1.

That is, the clearance t1 between the arc-shaped protruding portion 86 and the third corner forming surface 78 is set smaller than the initial thickness t of the workpiece W1 prior to performing the press forming process. Further, the clearance t2 between the first top forming surface 62 and the second top forming surface 80 is set larger than the initial thickness t of the workpiece W1 prior to performing the press forming process.

Further, in this embodiment, the step 90 is set larger than the step 88.

It is preferred that the protruding amount of the arc-shaped protruding portion 86, that is, the height of the steps 88 and 90 falls within the range of 1% to 12% of the initial thickness t of the workpiece W1.

Further, it is more preferred that the length L1 of an arc portion in the arc-shaped protruding portion 86, the length L2 of an inner wall surface in the first corner part 14 and the initial thickness t of the workpiece W1 satisfy the following equation (2).

$$L1=L2\pm t \quad (2)$$

Figure 12:
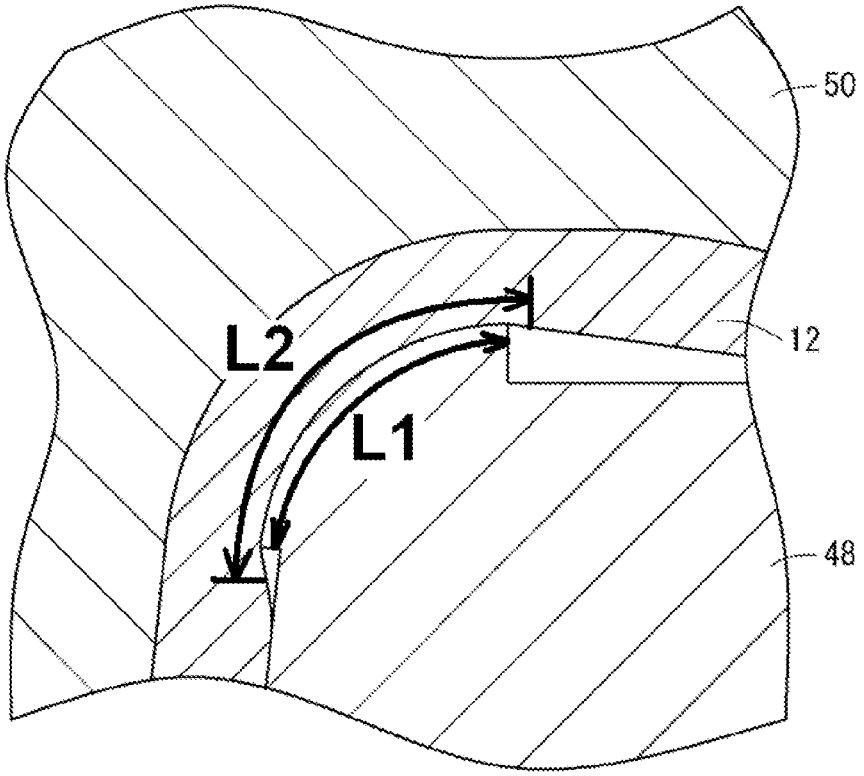
FIG. 12 is a view indicating a length L1 an arc portion of an arc-shaped protruding portion and a length L2 of an inner wall surface of a first corner part on FIG. 6.

The "L1" and "L2" are indicated in FIG. 12.

When equation L1>L2+t is established, a bending effect due to a moment tends to be decreased. On the contrary, when equation L1<L2−t is established, a compression action tends to be decreased.

The third corner forming surface 78 is formed as a simple arc-shaped corner surface having a radius r2 of curvature. The radius r2 of curvature is set to allow an outer wall surface of the first corner part 14 to be curved in a predetermined radius curvature.

Further, in the first embodiment, a clearance t3 between the first slant forming surface 58 of the second lower die 48 and the third slant forming surface 76 of the second upper die 50 is set equal to or slightly smaller than the initial thickness t of the workpiece W1.

The above configurations can be similarly applied to the second corner forming surface 64 and the fourth corner forming surface 82. Accordingly, a detailed description thereof will be omitted.

The first press forming apparatus 26 and the second press forming apparatus 46 according to the first embodiment are basically configured as mentioned above. Next, effects theses forming apparatus will be described with reference to the relationship with the press forming method.

In the first embodiment, the workpiece W1 is subjected to the first press forming process to obtain a preform W2. And then, the preform W2 is subjected to the second press forming process to alleviate a spring-back occurred in the preform W2 (see, FIG. 2).

Figure 3:
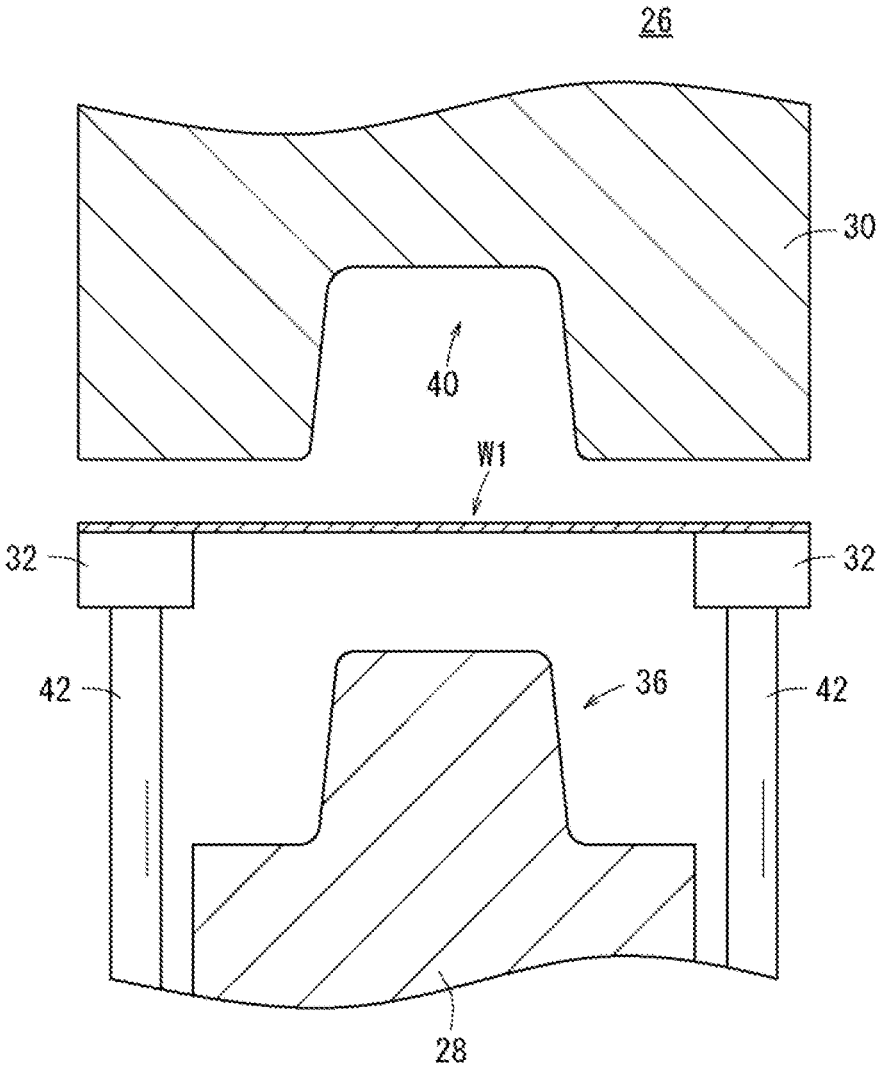
FIG. 3 is a longitudinal sectional view schematically illustrating a main part of a first press forming apparatus according to the first embodiment.

First, the first press forming apparatus illustrated in FIG. 3 is used to perform a first press forming process for a plate-shaped workpiece W1.

When the workpiece is subjected to the first press forming process, the workpiece W1 is first placed between the first lower die 28 and the first upper die 30 in a state where these dies are open. At this time, the workpiece W1 is placed on the blank holder 32. In this state, all cushion pins 42 are maximally elevated.

Subsequently, in order to perform the press forming process, the lifting mechanism is biased to lower the first upper die 30 and thereby the first lower die approaches to the first lower die 28. The surface of the first upper die 30 opposite to the blank holder 32 is first contact with a portion of the workpiece W1 placed on the blank holder 32.

As the first lower die 30 is further lowered, all cushion pins 42 are simultaneously lowered by an urging force of the first upper die 30. That is, the pluralities of blank holders 32 are simultaneously lowered.

The first upper die 30 is continuously lowered. By doing so, the cushion pins 42 are further operated and the first convex portion 36 of the first lower die 28 and a part of the workpiece W1 moves into the first concave portion 40 of the first upper die 30.

As illustrated in FIG. 4, as the first upper die 30 is maximally lowered, the cushion pin 42 is also maximally lowered. At this time, the workpiece W1 is held by the first lower die 28 and the blank holder 32 and the first upper die 30. Further, the workpiece W1 is formed into a shape corresponding to the shape of the first cavity 44 which is formed by the first concave portion 40 and the first convex portion 36 entering the first concave portion 40. Thereby, the first press forming process is finished to obtain the preform W2 illustrated in FIG. 2.

Thereafter, the first upper die 30 is spaced apart from the first lower die 28 under the action of the lifting mechanism to open the dies. Thereby, the preform W2 can be separated from the first press forming apparatus 26. In the prior art, the preform W2 thus obtained is utilized as a product as it is. However, in this preform W2, the amount of the spring-back is relatively large, as illustrated in FIG. 2.

For this reason, the second press forming process is subsequently performed. Specifically, the preform W2 is set into the second lower die 48 of the second press forming apparatus 46 illustrated in FIG. 5. In order to perform the press forming process, the lifting mechanism is biased to lower the second upper die 50, so that the second upper die approaches the second lower die 48. As the second upper die 50 is further lowered, the second convex portion 56 of the second lower die 48 and a part of the preform W2 enter the second concave portion 74 of the second upper die 50.

At this time, one end of the preform W2 is held between the first flange forming surface 52 and the third flange forming surface 68 and the other end thereof is held between the second flange forming surface 54 and the fourth flange forming surface 70. Thereby, the first flange 22 and the second flange 24 are formed. Further, a part of the preform W2 interposed between the first top forming surface 62 and the second top forming surface 80 is formed as the ceiling wall 12.

Simultaneously, as most of the preform W2 and the second convex portion 56 enter the second concave portion 74, a bending process for the preform W2 is performed. As a result, the first slant wall 18 and the first corner part 14 are formed between the first flange 22 and the ceiling wall 12. And, the second corner part 16 and the second slant wall 20 are formed between the ceiling wall 12 and the second flange 24.

FIG. 6 illustrates a part which is formed into the first corner forming surface 60 (arc-shaped protruding portion 86) and the third corner forming surface 78. As mentioned above, the clearance t1 between the arc-shaped protruding portion 86 and the third corner forming surface 78 is set smaller than the initial thickness t of the workpiece W1 and the clearance t2 between the first top forming surface 62 and the second top forming surface 80 is set larger than the initial thickness t of the workpiece W1. Accordingly, the preform W2 is pressed between the arc-shaped protruding portion 86 and the third corner forming surface 78, but is not pressed between the first top forming surface 62 and the second top forming surface 80. Furthermore, in this embodiment, the clearance t3 between the first slant forming surface 58 and the third slant forming surface 76 is set equal to or slightly smaller than the initial thickness t of the workpiece W1. Accordingly, the first slant wall 18 is held between the first slant forming surface 58 and the third slant forming surface 76 and thus constrained.

Therefore, a part of material which is formed into the first corner part 14 is flowing toward the ceiling wall 12, as illustrated by an arrow in FIG. 6. This is because the preform W2 is not constrained between the first top forming surface 62 and the second top forming surface 80 as stated above and thus the material is liable to flow into the clearance therebetween. Especially, such a phenomenon is prominent on the inner wall surface of arc-shaped protruding portion 86.

Owing to the flowing of the material as mentioned above, the inner wall surface (lower end surface) of the ceiling wall 12 is slightly bent toward the first top forming surface 62. In other words, the inner wall surface is warped. In this way, it is possible to avoid the material on a side of the inner wall surface of the first corner part 14 to be excessive and to avoid the material on a side of the outer wall surface thereof to be short. Further, the first corner part 14 is pressed in a plate thickness direction thereof so that the difference between the compressive residual stress on the inner wall surface and the tensile residual stress on the outer wall surface can be reduced.

Although illustration and detailed description will be omitted, the same phenomenon can be occurred in the second corner part 16.

Figure 7:
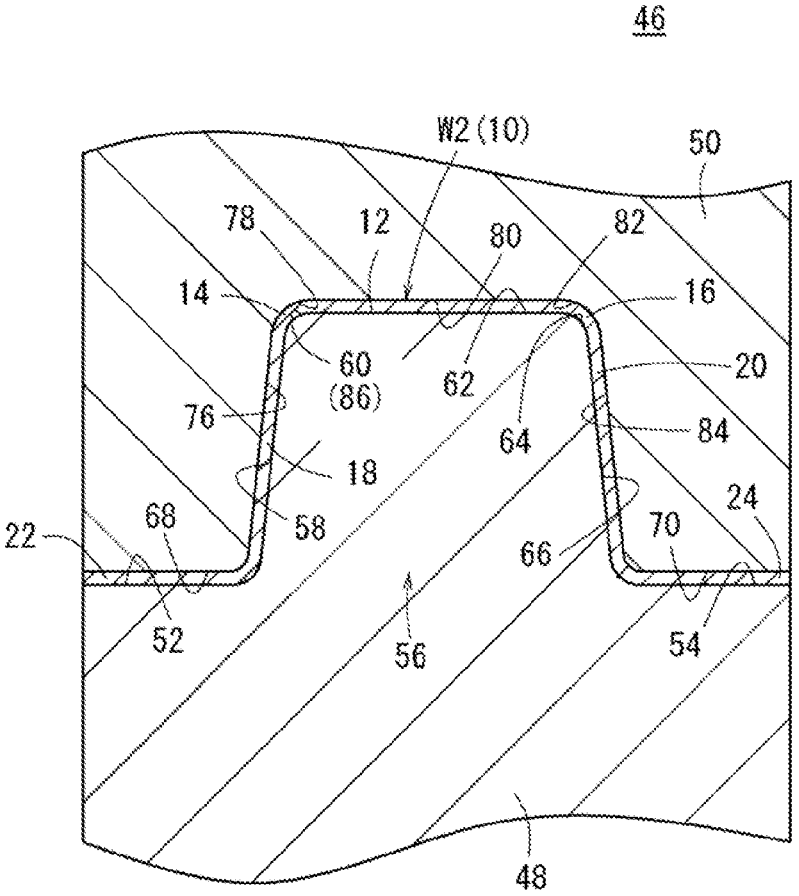
FIG. 7 is a longitudinal sectional view schematically illustrating a main part of the first press forming apparatus in a state where the upper die constituting the second press forming apparatus is maximally lowered.
Figure 8:
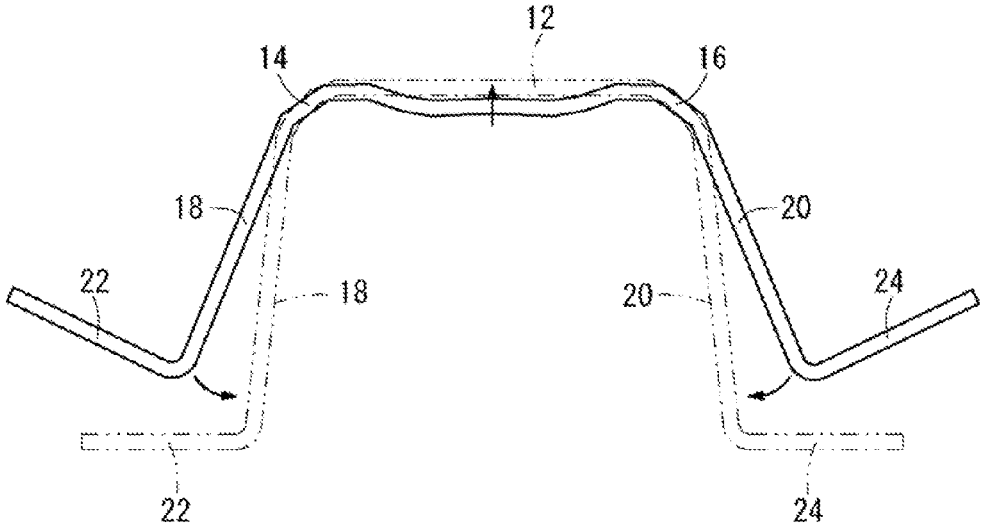
FIG. 8 is a side view schematically illustrating a press-product which is obtained by the press forming method according to the embodiment and is deformed after a pressing force is released.

When the second upper die 50 is maximally lowered, as illustrated in FIG. 7, the second press forming process is finished to obtain the press-product 10 illustrated in FIG. 1.

And then, the second upper die 50 is spaced apart from the second lower die 48 under the action of the lifting mechanism to open the dies. Thereby, the press-product 10 can be separated from the second press forming apparatus 46.

As mentioned above, in the preform W2 obtained by performing the first press forming process, a relatively large amount of spring-back is occurred in the first corner part 14 and the second corner part 16, as illustrated in FIG. 2. As a result, the first slant wall 18 and the second slant wall 20 bounce in a direction opposite to the pressing direction during the press forming, that is, toward the ceiling wall 12. The reason is as follows. That is, since compressive residual stress occurs on the inner wall surface of the first corner part 14 and the second corner part 16 and a large tensile residual stress occurs on the outer wall surface thereof, the first slant wall 18 and the second slant wall 20 try to return back to their original position by the action of the large tensile residual stress on the outer wall surface if the first slant wall 18 and the second slant wall 20 is released from a pressing force.

On the contrary, in the press-product 10 obtained by the press forming method according to the first embodiment, the amount of the spring-back is relatively small, as compared to the prior art. This is considered due to the fact that since a material for the preform W2 is caused to flow toward the ceiling wall 12 in the process of forming the first corner part 14 and the second corner part 16, the following phenomenon occurs.

That is, since the first corner part 14 and the second corner part 16 are pressed in the thickness direction thereof, it is possible to reduce the difference between the tensile residual stress on the outer wall surface of the first corner part 14 and the second corner part 16 and the compressive residual stress on the inner wall surface thereof. Furthermore, as the material flows toward the ceiling wall 12, the ceiling wall 12 is slightly bent toward the first top forming surface 62, as mentioned above. At this time, when the dies are opened, the bent state is returned to its original position. By such a return operation, the first slant wall 18 and the second slant wall 20 are displaced in a direction of the inner wall surface, thereby approaching to each other. That is, a force is applied in a direction to cancel the spring-back of the first corner part 14 and the second corner part 16. Thereby, the bounce of the first slant wall 18 and the second slant wall 20 is suppressed.

Further, since the material of the preform W2 flows easily, the local stretch of the first corner part 14 and the second corner part 16 can be suppressed and thus breakage concerns can be dispelled. Especially, in a case where the protruding amount of the arc-shaped protruding portion 86 (see, FIG. 6) is set within a range of 1 to 12% of the initial thickness t of the workpiece W1, the material of the preform W2 flows further easily.

Further, by setting the length L1 of an arc portion in the arc-shaped protruding portion 86, the length L2 of an inner wall surface in the first corner part 14 and the initial thickness t of the workpiece W1 to satisfy the above equation (2), it is possible to secure a sufficient bending effect and to avoid an insufficient compression.

In the second press forming process, a trimming process may be performed.

Figure 9:
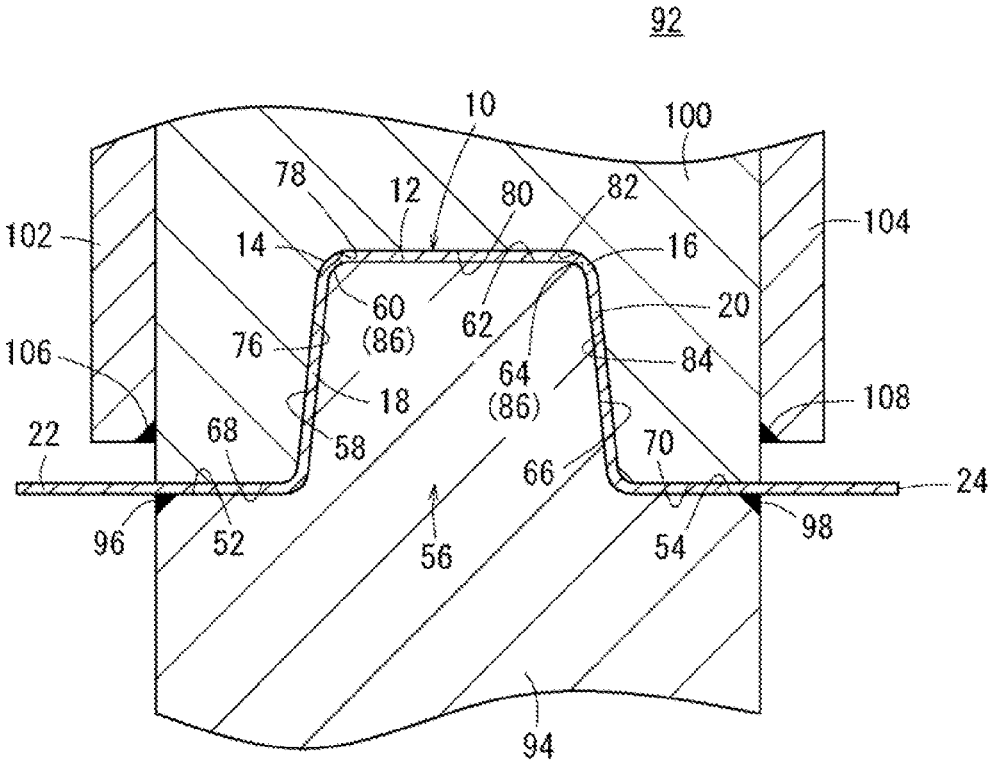
FIG. 9 is a longitudinal sectional view schematically illustrating a main part of a press forming apparatus for a trimming process according to the first embodiment.

In this case, the preform W2 obtained by the first press forming process is set on the third lower die 94 of a press forming apparatus 92 (hereinafter, simply referred to as press forming apparatus) for performing the trimming process, as illustrated in FIG. 9. Herein, the third lower die 94 of the press forming apparatus 92 has same configuration as the second lower die 48 of the press forming apparatus 46, except for including lower blades 96, 98. Accordingly, the same or similar element will be denoted by the same reference numeral as that of the second lower die 48 and detailed description thereof will be omitted.

The press forming apparatus 92 further includes trim dies 102, 104. The trim dies 102, 104 are provided with upper blades 106, 108 and can be displaced in a vertical direction under the action of a lifting mechanism (not illustrated) which is different from a lifting mechanism for lifting a third upper die 100.

After the preform W2 is set on the third lower die 94 of the press forming apparatus 92, the dies are closed in a state illustrated in FIG. 9. Since the arc-shaped protruding portion 86 is protruding from the first corner forming surface 60 and the second corner forming surface 64 of the third lower die 94, similar to the configuration illustrated in FIG. 6, the material for the first corner part 14 and the second corner part 16 of the preform W2 flows toward the ceiling wall 12. Accordingly, the material of the ceiling wall 12 is bent toward the first top forming surface 62.

Figure 10:
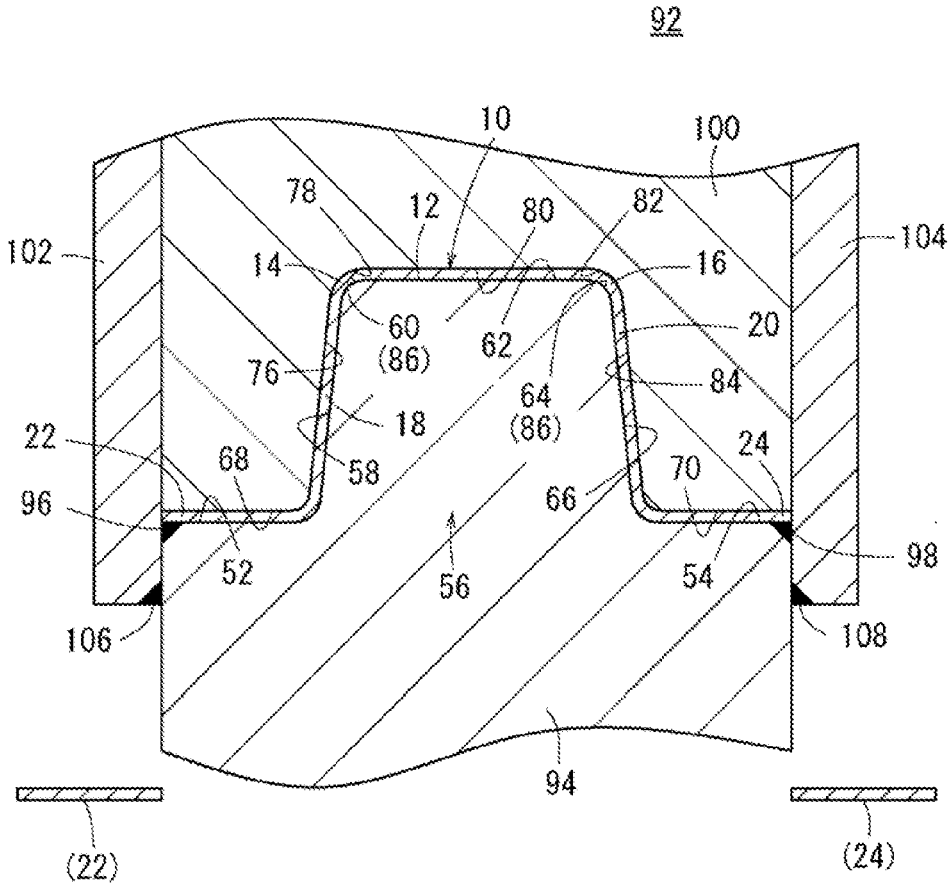
FIG. 10 is a longitudinal sectional view schematically illustrating a main part of the press forming apparatus in a state where the trim die constituting the second press forming apparatus of FIG. 9 is maximally lowered.

Thereafter, as illustrated in FIG. 10, the trim dies 102, 104 are lowered under the action of the lifting mechanism. At this time, a part of the first flange 22 and the second flange 24 of the press-product 10 is cut away by the lower blades 96, 98 and the upper blades 106, 108. Accordingly, a press-product 10 with a predetermined length can be obtained.

Subsequently, the dies are opened to take out the press-product 10. For the same reason as mentioned above, the amount of the spring-back is also reduced in this press product 10.

Although the press-product 10 is formed by performing the first press forming process and the second press forming process in the foregoing first embodiment, the press-product 10 may be formed by performing single press forming process for the plate-shaped workpiece W1. Hereinafter, this case will be described as a second embodiment.

In the second embodiment, the press-product 10 is obtained directly from the plate-shaped workpiece W1. That is, first, the workpiece W1 is placed on the second lower die 48 of the second press forming apparatus 46.

Thereafter, a forming process is performed as in the second press forming process in the first embodiment. That is, as illustrated in FIG. 4, the second upper die 50 of the second press forming apparatus 46 is lowered. At this time, as the second convex portion 56 of the second lower die 48 and a part of the workpiece W1 enter the second concave portion 74 of the second upper die 50, a bending process for the workpiece W1 is performed to form a corner part, that is, the first corner part 14 and the second corner part 16. Further, a part corresponding to the ceiling wall 12 is retained on the first top forming surface 62.

Since the first corner part 14 is pressed between the first corner forming surface 60 (arc-shaped protruding portion 86) and the third corner forming surface 78 and the second corner part 16 is pressed between the second corner forming surface 64 (arc-shaped protruding portion 86) and the fourth corner forming surface 82, the material for the corner part flows toward the ceiling wall 12. As a result, a force is applied in a direction to reduce the spring-back of the first corner part 14 and the second corner part 16 and therefore the amount of the spring-back can be suppressed, as in the first embodiment. Herein, in the second embodiment, the relationship between the initial thickness t of the workpiece W1 and the clearances t1 to t3 in the second press forming apparatus 46 is same as the first embodiment.

Figure 11:
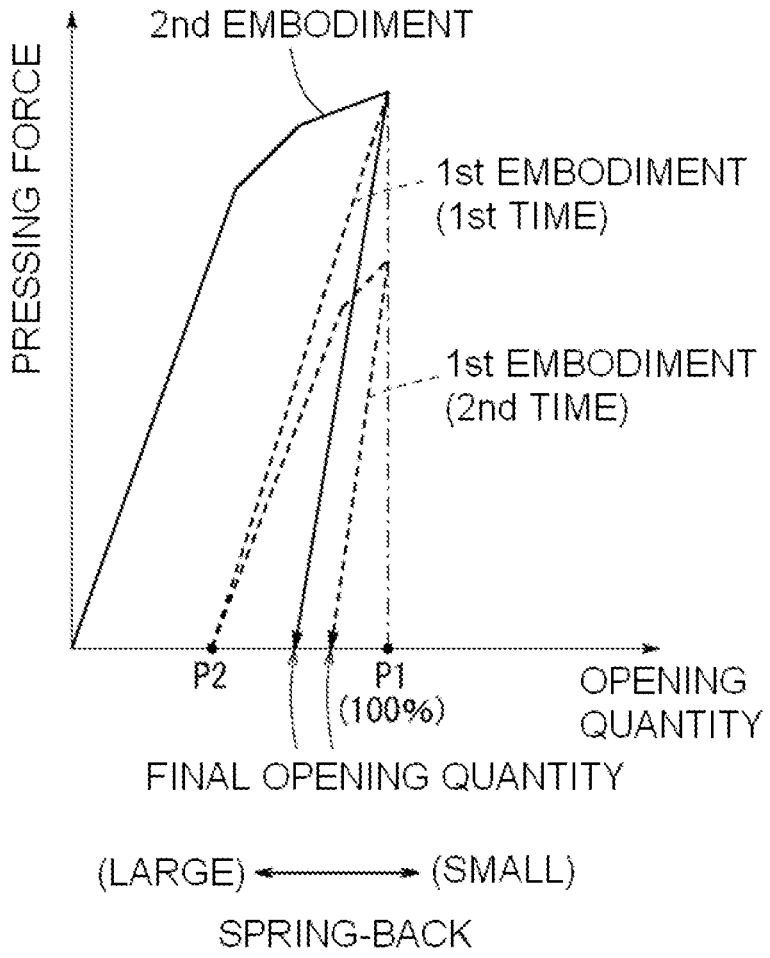
FIG. 11 is a graph illustrating a percentage of an opening quantity of the first slant wall and the second slant wall of the press-product relative to a target value respectively in the first embodiment and a second embodiment.

FIG. 11 illustrates a percentage of an opening quantity of the first slant wall 18 and the second slant wall 20 relative to a target value respectively in the first embodiment and the second embodiment. The point 1 in FIG. 11 represents a state where an actual opening quantity coincides with the target value and this state is referred to as 100%. As the spring-back is larger, the percentage is smaller. Further, the point P2 in FIG. 11 represents an amount of the spring-back occurred in the preform W2 due to the first press forming process of the first embodiment, that is, an amount of the spring-back occurred in a conventional press forming process.

As is apparent from FIG. 11, the percentage of the opening quantity in the first embodiment is larger than that of the opening quantity in the second embodiment. That is, an amount of the spring-back in the first embodiment is smaller than that of the spring-back in the second embodiment. This means that an amount of the spring-back can be further reduced by twice press forming process.

The present invention is not limited to the first embodiment and the second embodiment mentioned above and can be variously modified without departing from the gist of the invention.

For example, although the step 88 is formed between the arc-shaped protruding portion 86 and the first slant forming surface 58 and the step 90 is formed between the arc-shaped protruding portion 86 and the first top forming surface 62 in FIG. 6, a slant part or a corner part may be provided, instead of the steps 88, 90. Specifically, the arc-shaped protruding portion 86 and the first slant forming surface 58 (second slant forming surface 66) and also the arc-shaped protruding portion 86 and the first top forming surface 62 are respectively connected to each other via the slant part or the corner part.

Further, the second lower die 48 and the third lower die 94 may have a concave shape and the second upper die 50 and the third upper die 100 may have a convex shape. In this case, the inner wall surface of the press-product 10 is opposed to the second upper die 50 and the third upper die 100 and the outer wall surface thereof is opposed to the second lower die 48 and the third lower die 94. Accordingly, the arc-shaped protruding portion 86 can be formed on the second upper die 50 and the third upper die 100.

According to the above embodiments, a method of manufacturing a product 10 including a top surface part 12, a vertical wall part 18, 20 connected to an end of the top surface part 12 and a corner part 14, 16 interposed between the top surface part 12 and the vertical wall part 18, 20 by applying a pressing force on a workpiece W1, W2, may include a step of flowing a material of the corner part 14, 16 toward the top surface part 12.

The above method may further include a step of applying a pressing force on the corner part 14, 16 while constraining the vertical wall part 18, 20.

The above method may further include a step of forming pre-bent part on a part of the workpiece to be formed as the corner part 14, 16, prior to forming the corner part 14, 16, and a step of bending the pre-bent part in which a spring-back occurs in a direction opposite to the direction of the spring-back to form the corner part 14, 16.

Moreover, according to the above embodiments, a press forming apparatus configured to form a product 10 including a top surface part 12, a vertical wall part 18, 20 connected to an end of the top surface part 12 and a corner part 14, 16 interposed between the top surface part 12 and the vertical wall part 18, 20, may include a first forming die 48, 94 and a second forming die 50, 100 adapted to apply a pressing force on a workpiece W1, W2. In a condition that a cavity 72 is formed between the first forming die 48, 94 and the second forming die 50, 100, a clearance t1 between the first forming die and the second forming die at an area for forming the corner part 14, 16 may be smaller than a thickness t of the workpiece, and a clearance t2 between the first forming die and the second forming die at an area for forming the top surface part 12 may be larger than the thickness t of the workpiece.

In the above apparatus, the first forming die 48, 94 may include a convex portion 56 having a top forming surface 62 corresponding to the top surface part 12, a vertical wall forming surface 58, 66 corresponding to the vertical wall part 18, 20, and a corner forming surface 60, 64 positioned between the top forming surface 62 and the vertical wall forming surface 58, 66 and corresponding to the corner part 14, 16. The second forming die 50, 100 may include a concave portion 74 into which the convex portion 56 enters to form the cavity 72 between the convex portion 56 and the concave portion 74. A protruding portion 86 may be formed on the corner forming surface 60, 64 of the convex portion 56, wherein each of the protruding portion 86 is adapted to apply a pressing force on the corner part 14, 16 in a direction from an inner wall surface toward an outer wall surface of the corner part 14, 16.

In the above apparatus, a protruding amount of the protruding portion 86 may be within a range of 1% to 12% of the thickness t of the workpiece.

According to the method and the apparatus of the embodiments, since the corner parts are pressed in a plate thickness direction thereof, the difference between the compressive residual stress on the inner wall surface of the corner part and the tensile residual stress on the outer wall surface thereof can be reduced. Accordingly, a force tensioning the inner wall surface toward the outer wall surface is small. Further, since the material of the corner part is caused to flow toward the top surface part, the top surface part is slightly bent toward the inner wall surface by such a flowing of the material. Accordingly, when the dies are opened and the pressing force is released, the bent state tries to return toward the outer wall surface. By these configurations, it is possible to reduce the spring-back.

Further, since the material of the workpiece flows easily, breakage concerns of the workpiece can be dispelled.

Further, since the workpiece is pressed by the forming surface for forming the corner part, it is possible to solve the problem that the thickness of the corner part is locally thin and the strength of the corner part is degraded.

What is claimed is:

1. A method of manufacturing a press product from a workpiece, the press product including a top surface part, a vertical wall part connected to an end of the top surface part, and a corner part interposed between the top surface part and the vertical wall part, the press product being formed by applying a pressing force on the workpiece by a forming die, the method comprising:

flowing a material of the corner part toward the top surface part; and applying a pressing force on the corner part with the forming die in a direction from an inner wall surface toward an outer wall surface of the corner part while constraining the vertical wall part and both surfaces of the corner part, with a portion of the top surface part unconstrained, such that material flows from the corner part toward the unconstrained portion of the top surface part during application of the pressing force.

2. The method according to claim 1, further comprising:

forming a pre-bent part on a part of the workpiece to be formed as the corner part, prior to forming the corner part; and bending the pre-bent part in which a spring-back occurs, in a direction opposite to a direction of the spring-back to form the corner part.

* * * * *